US005179763A

United States Patent [19]

Zander et al.

[11] Patent Number: 5,179,763

[45] Date of Patent: Jan. 19, 1993

[54] METHOD AND APPARATUS FOR OPENING FIBER BALES ALONG AN INCLINED PLANE

[75] Inventors: Johann Zander, Mönchengladbach; Josef Temburg, Jüchen, both of Fed. Rep. of Germany

[73] Assignee: Trützschler GmbH & Co. KG, Mönchengladbach, Fed. Rep. of Germany

[21] Appl. No.: 806,250

[22] Filed: Dec. 13, 1991

[30] Foreign Application Priority Data

Dec. 15, 1990 [DE] Fed. Rep. of Germany ..... 4040197

[51] Int. Cl.[5] ..... D01G 7/06

[52] U.S. Cl. ..... 19/80 R; 19/145.5

[58] Field of Search ..... 19/80 R, 81, 145.5

[56] References Cited

U.S. PATENT DOCUMENTS

| | | | |
|---|---|---|---|
| 4,377,021 | 3/1983 | Peters | 19/80 R |
| 4,928,354 | 5/1990 | Hanselmann et al. | 19/80 R X |
| 4,951,358 | 8/1990 | Binder et al. | 19/80 R |
| 5,044,045 | 9/1991 | Demuth et al. | 19/80 R |
| 5,105,507 | 4/1992 | Staheli et al. | 19/80 R |
| 5,105,508 | 4/1992 | Aebli et al. | 19/80 R |

FOREIGN PATENT DOCUMENTS

| | | | |
|---|---|---|---|
| 0918345 | 4/1982 | U.S.S.R. | 19/80 R |
| 0956643 | 9/1982 | U.S.S.R. | 19/80 R |
| 0971932 | 11/1982 | U.S.S.R. | 19/80 R |
| 1063880 | 12/1983 | U.S.S.R. | 19/80 R |
| 1340519 | 12/1973 | United Kingdom . | |
| 2175927 | 12/1986 | United Kingdom . | |
| 2209771 | 5/1989 | United Kingdom . | |

*Primary Examiner*—Werner H. Schroeder
*Assistant Examiner*—John J. Calvert
*Attorney, Agent, or Firm*—Spencer, Frank & Schneider

[57] ABSTRACT

A method of detaching fiber tufts from a top surface of serially-arranged fiber bales by a bale opener includes the steps of propelling the bale opener for back-and-forth travel along the fiber bale series, vertically moving, simultaneously with the propelling step, the detaching device relative to the supporting structure and simultaneously with the propelling step and the vertical displacement of the detacher, removing fiber tufts by the detaching device in consecutive passes. During the run-in phase (in which the surface of the bale series is changed from a substantially horizontal orientation to a predetermined oblique orientation for normal detaching operation) and during a run-out phase (in which the surface of the bale series is changed from an oblique orientation to a substantially horizontal orientation) the following steps are performed in each consecutive pass: a new top bale surface is formed which has an inclination to the horizontal that is different from the previously-formed surface and varying the speed of travel of the bale opener structure during each pass.

17 Claims, 5 Drawing Sheets

Y
A
B
3I
3II
3a
X
I
II vmax
vmin
t
[min]

P
t
[min]

METHOD AND APPARATUS FOR OPENING FIBER BALES ALONG AN INCLINED PLANE

BACKGROUND OF THE INVENTION

This invention relates to a method and an apparatus for detaching fiber tufts from serially arranged fiber bales, such as cotton bales, chemical fiber bales and the like. The detaching operation is effected by a bale opener which moves back and forth along the fiber bales and carries a detaching (opening) device proper which has at least one detaching (opening) roll. The detaching device is accommodated in a downwardly open cantilever housing carried by and projecting laterally from the travelling opener tower. The detaching device may be moved vertically relative to the tower.

According to a known method, the cantilever housing, together with the fiber tuft detaching device may be adjusted in a vertical plane to assume a desired inclined angle to the horizontal travelling direction of the tower. By virtue of this arrangement, it is feasible to detach fiber tufts from fiber bales with a single detaching device either in a horizontal plane or in an inclined plane.

It is a disadvantage of the above-outlined known method that the fiber tuft output during the run-in period, that is, during the transition of the fiber bale surface from a horizontal plane to a plane of determined inclination for the continuous operation is significantly less at the beginning of the fiber bale series than at the end thereof. It is a further disadvantage of the known method that the run-in period is excessively long. Similarly, these disadvantages also characterize the run-out phase, that is, during the transition of the top face of the bale series from the inclined orientation for the continuous operation to the horizontal plane (defined by the top face of a residual, lowermost fiber layer of the consumed bales).

SUMMARY OF THE INVENTION

It is an object of the invention to provide an improved method and apparatus of the above-outlined type from which the discussed disadvantages are eliminated and which, in particular, ensure a uniform fiber tuft detaching output during the run-in and run-out phases and shorten the duration thereof.

This object and others to become apparent as the specification progresses, are accomplished by the invention, according to which, briefly stated, the method of detaching fiber tufts from a top surface of serially-arranged fiber bales by a bale opener includes the steps of propelling the bale opener for back-and-forth travel along the fiber bale series, vertically moving, simultaneously with the propelling step, the detaching device relative to the supporting structure and, simultaneously with the propelling step and the vertical displacement of the detaching device, removing fiber tufts by the detaching device in consecutive passes. During the run-in phase (in which the surface of the bale series is changed from a substantially horizontal orientation to a predetermined oblique orientation for normal detaching operation) and during a run-out phase (in which the surface of the bale series is changed from an oblique orientation to a substantially horizontal orientation) the following steps are performed in each consecutive pass: a new top bale surface is formed which has an inclination to the horizontal that is different from the previously-formed surface and varying the speed of travel of the bale opener structure during each pass.

Thus, according to the invention, in the run-in and run-out phases, during each pass a new angle is formed relative to the horizontal, that is, the bale top face becomes, after each pass, steeper in the run-in phase and less steep in the run-out phase. It is a significant advantage of the method according to the invention that the formation of the oblique surface (for the regular operation) from the horizontal initial face is automatically created. By virtue of the fact that, in contradistinction to the known processes, the speed of the travelling motion of the bale opener is varied in the run-in and run-out phase during each pass, a substantial uniformity of the fiber tuft output rate is ensured. It is a further advantage of the process according to the invention that the duration of the run-in and run-out phases is substantially shortened.

DESCRIPTION OF THE PREFERRED EMBODIMENTS

Figure 1A:
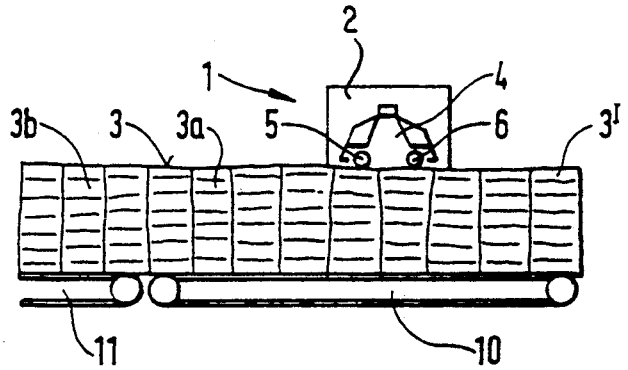
FIGS. 1*a*, 1*b* and 1*c* are sequential schematic side elevational views of the operation of a fiber bale opener in the run-in phase of the fiber tuft detaching operation according to the invention.
Figure 2A:
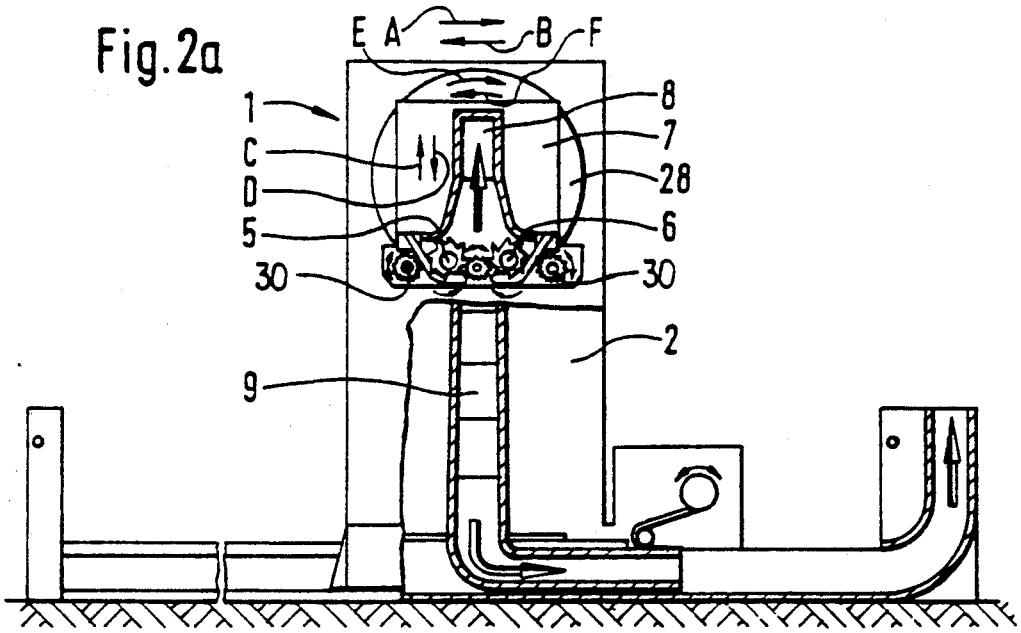
FIG. 2*a* is a schematic, partially sectional side elevational view of a preferred embodiment of the invention.
Figure 2B:
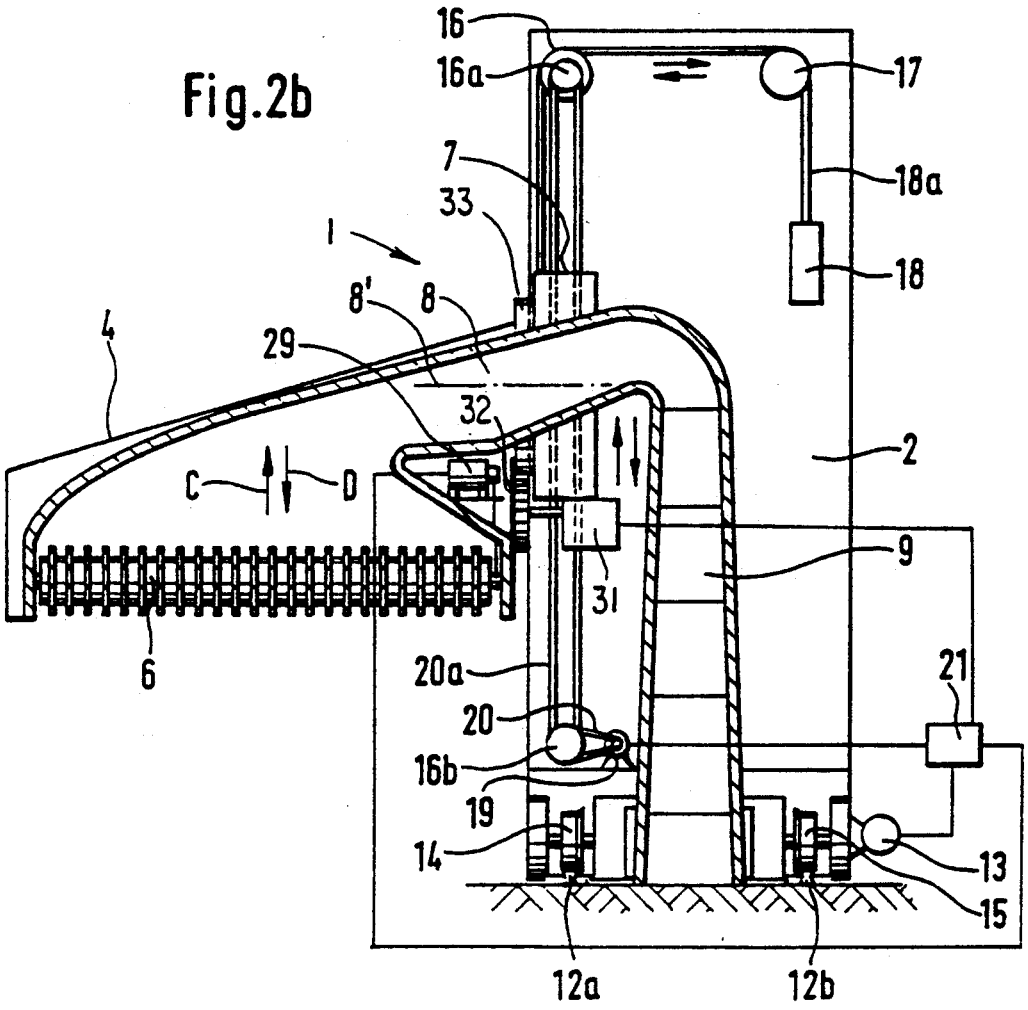
FIG. 2*b* is a schematic, partially sectional front elevational view of the construction shown in FIG. 2*a*.

Turning to FIGS. 1*a*, 2*a* and 2*b*, the fiber opener generally designated at 1 may be essentially a BLENDOMAT BDT model, manufactured by Trützschler GmbH & Co. KG, Mönchengladbach, Germany. The bale opener 1 has a travelling tower 2 which moves back and forth in the direction of arrows A, B parallel to a fiber ball series 3. From one side of the tower 2 there projects laterally a detaching (opening) device 4 which may have a single detaching (opening) roll or, as shown in FIG. 1*a*, may be provided with two oppositely rapidly rotated detaching rolls 5, 6. The detaching device 4 is mounted on the tower 2 by a supporting device 7. The fiber tufts torn from the fiber bales by the detaching rolls 5, 6 are removed by a suction stream through an outlet duct 8 accommodated within the detaching device 4 and a vertically downwardly extending suction conduit disposed within the tower 2.

The detaching device 4 is vertically movable relative to the tower 2 as shown by arrows C and D. The detaching device 4 is rotatable relative to the tower 2 as indicated by the arcuate arrows E and F about a horizontal axis which is perpendicular to the direction of opener travel A, B. Such angular displaceability of the detaching device 4 is preferably effected about a center horizontal mid line 8' of that portion of the outlet duct 8 that passes through the supporting device 7. The detaching device 4 may be rotated relative to the tower 2 about the axis 8' in either direction so that the detaching device 4, together with detaching (opening) rolls 5, 6 may be brought into a desired, predetermined oblique position relative to the fiber bale series 3. By virtue of this arrangement, the fiber bale series 3 may be worked on by means of the bale opener 1 along a plane which is inclined to the horizontal at a predetermined angle.

By virtue of the angularly adjustable detaching device 4 it is possible to continuously perform a fiber tuft detaching operation on the fiber bale series 3 by continuously adding full-height fiber bales to the left of the bale series 3, as the bales are being gradually consumed by the detaching device 4 on the right, as viewed in FIGS. 1*a* through 1*e*. For this purpose, the fiber bale series 3 is supported on serially arranged conveyor belts 10, 11 which feed the fiber bale series 3 in the direction of the arrows G and I relative to the travelling path of the detaching device 4. The fiber bales series 3 is composed of a subseries 3*a* formed of fiber bales supported on the conveyor belt 10 and a subseries 3*b* formed of fiber bales supported on the conveyor belt 11.

Figure 1B:
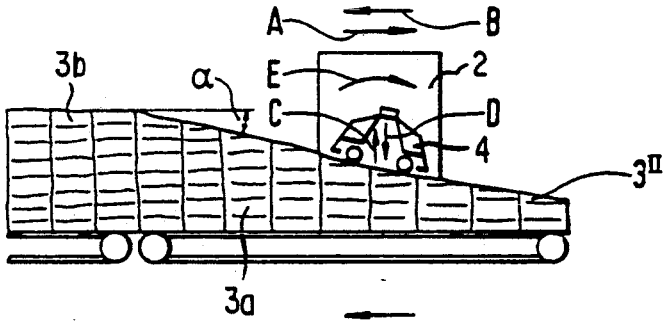
Figure 1C:
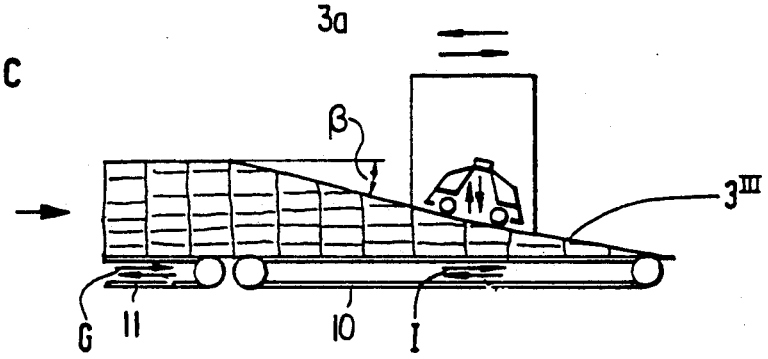

FIGS. 1*a*, 1*b* and 1*c* show the run-in phase during which the oblique surface $3^{III}$ (FIG. 1*c*) for normal operation is gradually formed from the horizontal surface $3^{I}$ (FIG. 1*a*). During the run-in phase the fiber bale series 3 is stationary on the conveyor belts 10 and 11. As the detaching operation start with full fiber bales throughout (initial position), the bale surface $3^{I}$ is of horizontal orientation. As shown in FIG. 1*b*, the bale opener tower 2 moves back and forth in the direction of the arrows A and B over the fiber bale subseries 3*a*. As the tower 2 moves in the direction A, the detaching device 4 is gradually lowered in the direction of the arrow D relative to the tower 2 whereas, conversely, when the tower travels in the direction B, the detaching device 4 moves upwardly relative to the tower 2 as indicated with the arrow C. After each pass, the detaching device 4 is angularly incrementally adjusted in the direction of the arcuate arrow E. In this manner, the horizontal upper face $3^{I}$ (FIG. 1*a*) of the bale subseries 3*a* gradually assumes the final operational oblique surface $3^{III}$ (FIG 1*c*). Thus, during each pass in the run-in phase a new intermediate oblique surface $3^{II}$ is formed (FIG. 1*b*) which forms an angle $\alpha$ with the horizontal. The speed $\underline{v}$ of the travelling speed of the tower 2 during the pass over the subseries 3*a* is altered such that during the downward motion (arrow D) of the detaching device 4 the speed $\underline{v}$ of the tower 2 decreases, whereas during the upward motion (arrow C) of the detaching device 4 the speed $\underline{v}$ of the tower 2 increases.

As noted above, FIG. 1*c* shows the normal operational phase in which the oblique bale surface $3^{III}$ which is at an angle $\beta$ to the horizontal remains of constant inclination and thus during the normal operational phase the angular position of the detaching device 4 relative to the tower 2 remains constant. During the normal operational phase the conveyor belts 10 and 11 advance the bale subseries 3*a* and 3*b* in unison in the direction G and I, preferably periodically after each pass of the detaching device 4.

Figure 1D:
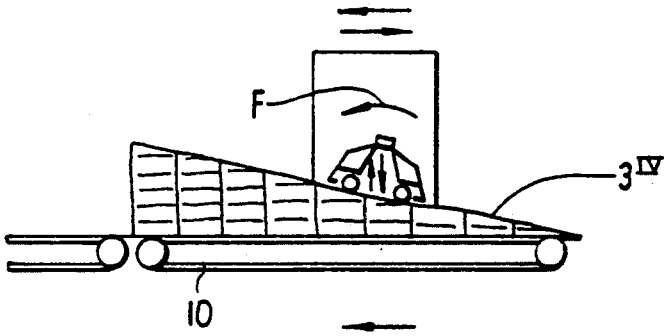
FIGS. 1*d* and 1*e* are sequential schematic side elevational views of the operation of a fiber bale opener in the run-out phase of the fiber tuft detaching operation according to the invention.
Figure 1E:
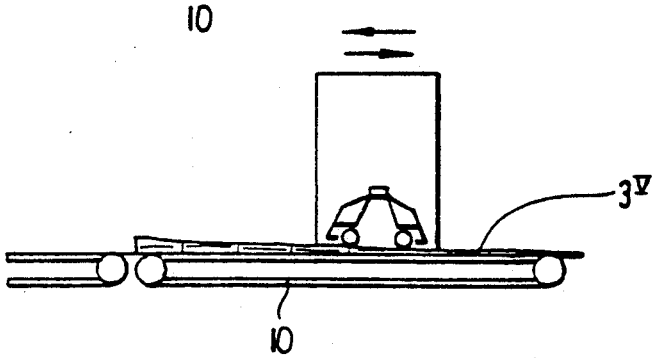

FIGS. 1*d* and 1*e* illustrate the run-out phase in which the inclined surface $3^{III}$ of the bale subseries 3*a* changes to the substantially horizontal surface $3^{V}$ through intermediary, gradually flattening surfaces $3^{IV}$. During the run-out phase the fiber bales remain stationary on the belt 10.

Turning once again to FIGS. 2*a* and 2*b*, the bale opener tower 2 is movable in the direction of the arrows A and B back and forth on wheels 14 and 15 which run on respective rails 12*a*, 12*b*. The wheels 14, 15 are driven by a motor 13. The supporting device 7 which mounts the detaching device 4 to the bale opener tower 2 for vertical movements thereon is suspended from a counterweight 18 by means of a cable 18*a* and support rollers 16, 17. A lifting motor 19 is operatively coupled to the supporting device 7 by means of transmission elements 20, 20*a* and deflecting rollers 16*a*, 16*b* for effecting a vertical adjustment of the detaching device 4. A drive motor 29 is mounted on the detaching device 4 and rotates the rolls 5 and 6, as well as pressing rolls 30 which flank the rolls 5 and 6. Appropriate step-down transmissions may provide a desired relationship between the rpm of the rolls 5, 6 and the rpm of the pressing rolls 30. The rotation of the detaching device 4 about axis 8' may be effected by a motor 31 which is mounted on the supporting device 7 and which drives a pinion 32 meshing with a ring gear 33 coupling the detaching device 4 to the supporting device 7. The motors 13, 19, 29 and 31 are connected to a control device 21 to coordinate with one another the travelling motion of the tower 2, the vertical motion of the detaching device 4, the rotational speed of the rolls 5, 6 and 30 as well as the angular setting of the detaching device 4.

Figure 3A:
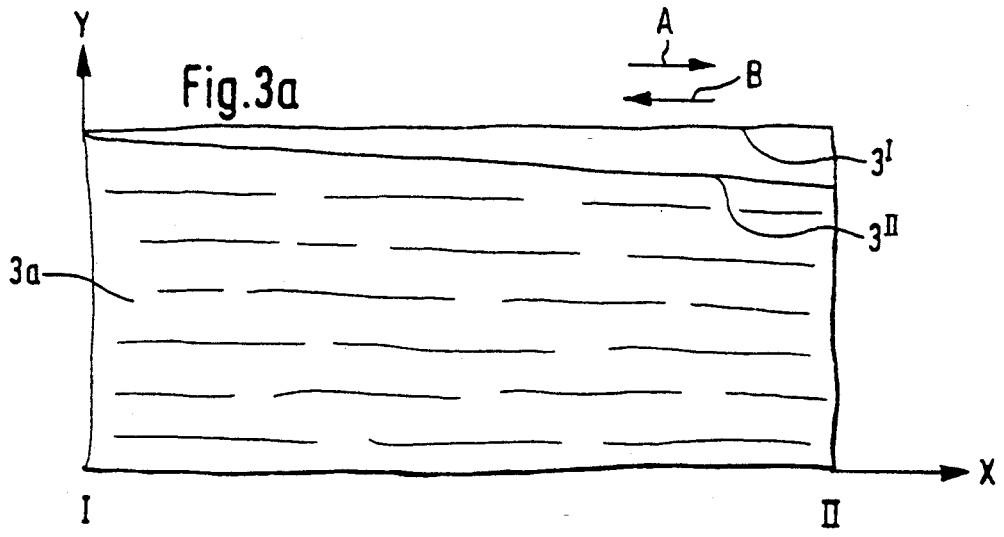
FIG. 3*a* is a side elevational view of a fiber bale series shown prior to commencement of the fiber tuft removing operation and after the completion of the first fiber detaching pass.
Figure 3B:
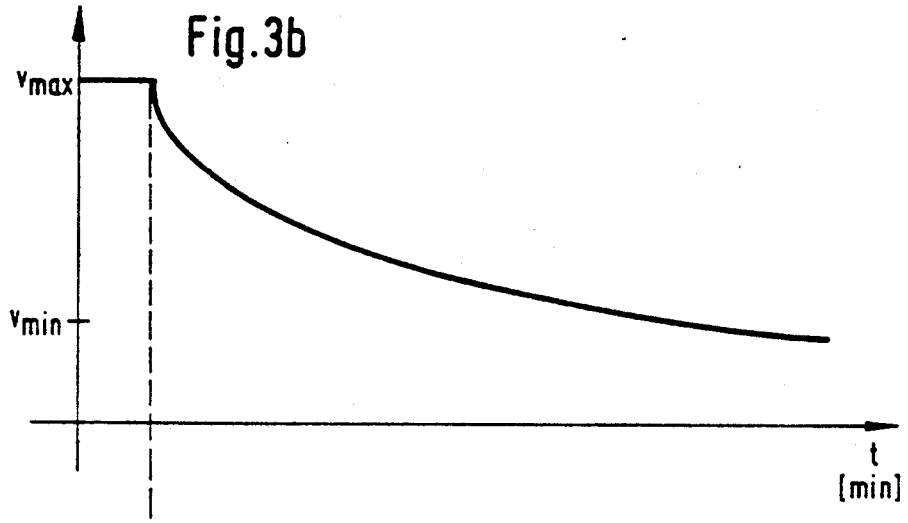
FIG. 3*b* is a diagram illustrating the travelling speed of the bale opener as a function of time during each pass.
Figure 3C:
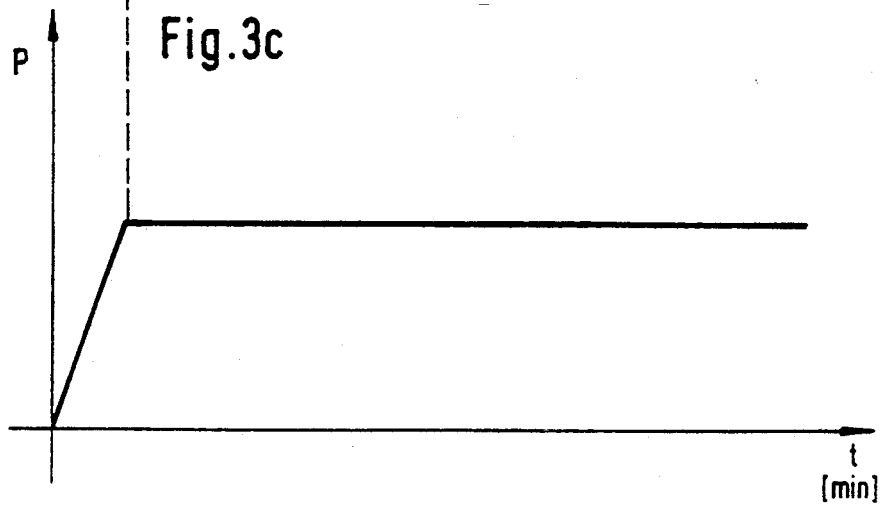
FIG. 3*c* is a diagram showing the fiber tuft output rate as a function of time during each pass.

FIG. 3*a* shows the bale subseries 3*a* which have a horizontal surface $3^{I}$ before the first pass and an inclined surface $3^{II}$ after the first pass during the run-in phase. The first pass starts at the end I of the subseries 3*a* and terminates at the end II thereof. The subsequent, second pass starts at II and terminates at I. During the first pass the tower 2 moves in the direction A (x-axis) while, at the same time, the detaching device 4 moves downwardly in the direction D along the y-axis. As shown in FIG. 3*b*, the travelling speed $\underline{v}$ of the tower 2 is decreased as a function of time during the first pass from I to II. Accordingly, the output P as shown in FIG. 3*c*, that is, the quantity of the fiber tufts removed from the fiber bales, remains constant during the first pass.

Figure 4:
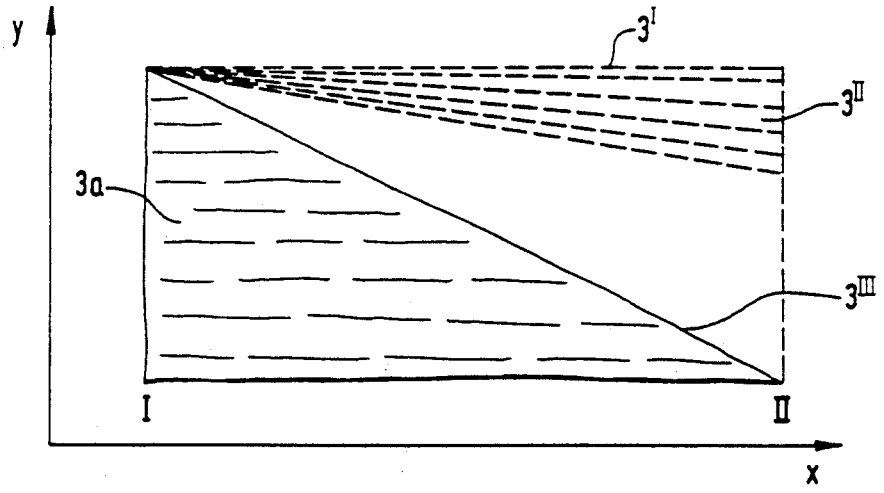
FIG. 4 is a side elevational view of a fiber bale series illustrating a transition of the top bale face from a horizontal plane through intermediary oblique planes to the final oblique plane for the normal detaching operation.

As illustrated in FIG. 4, the surface of the bale series changes in the run-in phase from the horizontal orientation $3^{I}$ through a plurality of intermediate orientations $3^{II}$ to the oblique surface $3^{III}$ for the normal detaching operation. It is apparent that a uniform production rate during the travel of the bale opener from I to II is ensured by compensating for the increase of the absolute production (fiber tuft quantities), caused by the increasing vertical feed of the detaching device 4 based on the angle of orientation. Such compensation is effected by decreasing the travelling speed v of the bale opener tower.

Figure 5:
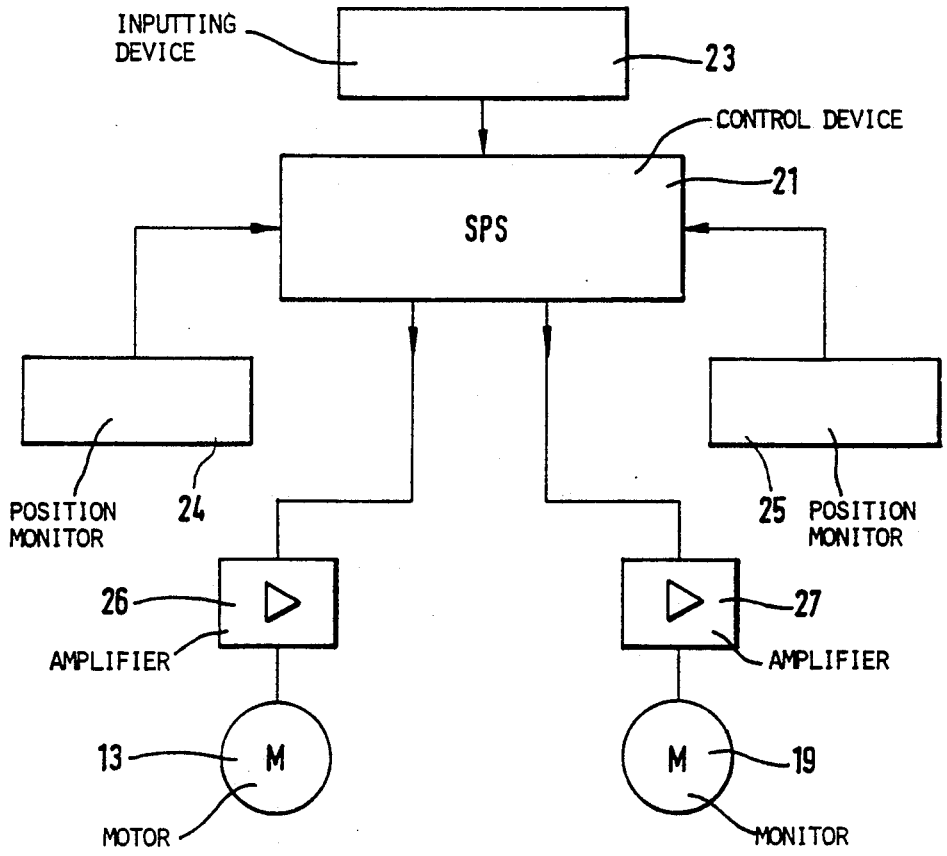
FIG. 5 is a block diagram of a control system forming part of the invention for the motion of the detaching device in the longitudinal (horizontal) and vertical directions.

Turning to FIG. 5, there is shown therein the control device 21 which may be, for example, a programmable device to which an inputting device 23 is connected. In addition to the connections described with reference to FIG. 2*b*, to the control device 21 there are further connected a position monitor 24 which may be, for example, an incremental angular position indicator associated with the motor 13, or an optical barrier or the like for the longitudinal direction (x-axis) and a position monitor 25, for example, an incremental angular position indicator associated with the motor 19, or an optical barrier or the like for the height direction (y-axis). Further, the control device 21 is connected by means of an amplifier 26 (start-up electronics, frequency converter) with the drive motor 13 and by means of an amplifier 27 with the lifting motor 19. Similar intermediary components may be provided between the control device 21 on the one hand and the motors 29 and 31, on the other hand.

Figure 6A:
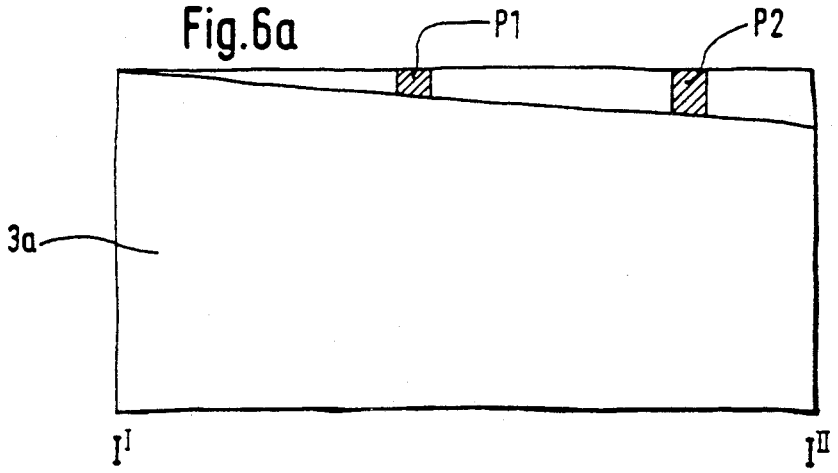
(PRIOR ART) Fig.6a
FIG. 6*a* is a diagram showing various production rates during a pass according to the prior art.
Figure 6B:
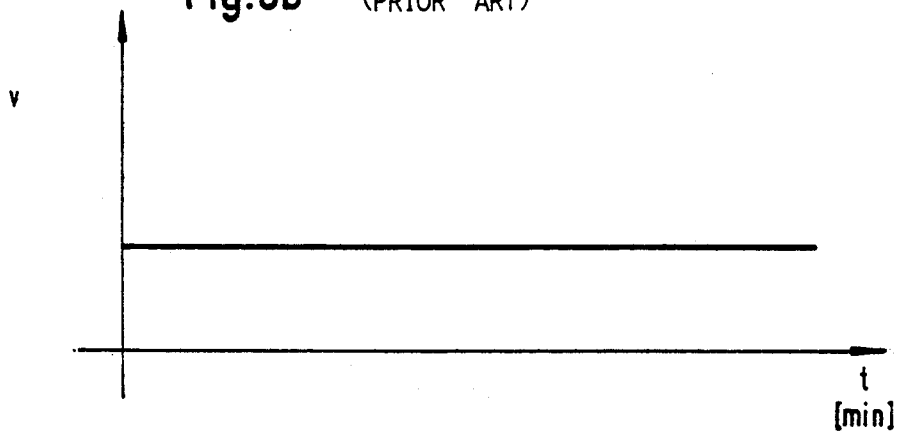
Fig.6b (PRIOR ART)
FIG. 6*b* is a diagram illustrating a constant bale opener travelling speed during each pass according to the prior art.
Figure 6C:
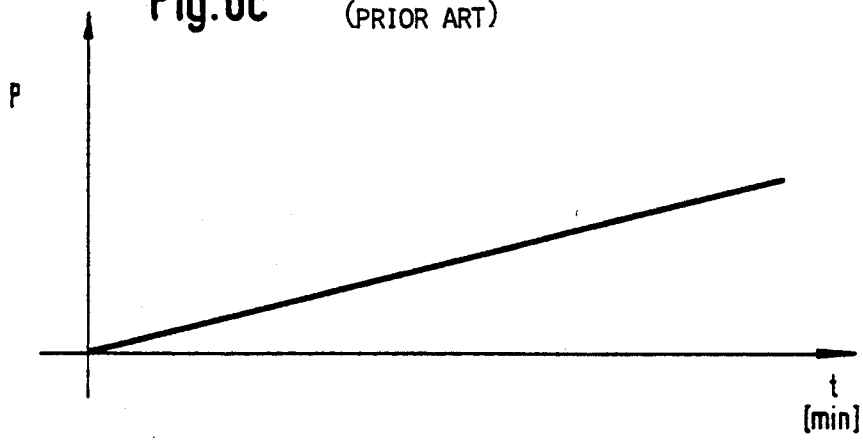
Fig.6c (PRIOR ART)
FIG. 6*c* is as diagram illustrating the varying production rate as a function of time during each pass according to the prior art.

FIG. 6*a*, 6*b* and 6*c* are diagrams showing an operation according to the prior art. In FIG. 6*a*, during the first pass at constant speed v in the longitudinal direction in the starting zone of the fiber bale series (at $I^I$) a smaller quantity P1 of fiber tufts per time unit is removed than in the end zone $I^{II}$ where the quantity of removed fiber tufts is designated at P2. FIG. 6*b* shows a constant travelling speed v for the tower 2 and FIG. 6*c* shows an increasing production rate. This increasing production (kg/min) is caused by the fact that the detaching device 4 is arranged at an angle to the horizontal so that the feed of the detaching device 4, that is, the penetration depth of the detaching rolls 5 and 6 into the bale surface in the height direction (y-axis) during movement in the longitudinal direction (x-axis) continuously increases.

The above disadvantageous non-uniformities in the production rates are eliminated according to the invention by altering the speed v in the x direction so that advantageously the production rate in the run-in and run-out phases remain uniform during each pass from I to II and conversely.

It will be understood that the above description of the present invention is susceptible to various modifications, changes and adaptations, and the same are intended to be comprehended within the meaning and range of equivalents of the appended claims.

What is claimed is:

1. In a method of detaching fiber tufts from a top surface of serially-arranged fiber bales by a bale opener having a supporting structure and a detaching device mounted on the supporting structure, including the steps of propelling the bale opener for back-and-forth travel along the fiber bale series, simultaneously with the propelling step, vertically moving the detaching device relative to the supporting structure and simultaneously with the propelling step and the vertically moving step, removing fiber tufts by the detaching device in consecutive passes;

the improvement comprising the following steps in each consecutive pass during run-in phase in which the surface of the bale series is changed from a substantially horizontal orientation to a predetermined oblique orientation for normal detaching operation and during a run-out phase in which the surface of the bale series is changed from an oblique orientation to a substantially horizontal orientation:

(a) forming a new surface of the bale series; said new surface having an inclination to the horizontal that is different from the inclination of a series surface formed during an immediately preceding pass; and (b) varying the velocity of travel of the bale opener structure during each pass.

2. A method as defined in claim 1, wherein said step of varying the velocity of travel includes the step of decreasing said velocity during a vertical, downward motion of the detaching device in the run-in phase.

3. A method as defined in claim 1, wherein said step of varying the velocity of travel includes the step of increasing said velocity during a vertical, upward motion of the detaching device in the run-in phase.

4. A method as defined in claim 1, wherein said step of varying the velocity of travel includes the step of increasing said velocity during a vertical, downward motion of said detaching device in the run-out phase.

5. A method as defined in claim 1, wherein said step of varying the velocity of travel includes the step of decreasing said velocity during a vertical, upward motion of said detaching device in the run-out phase.

6. A method as defined in claim 1, wherein said step of varying the velocity of travel includes the step of varying said velocity inversely proportional to a production rate of fiber tuft removal by said detaching device.

7. A method as defined in claim 1, wherein said step of varying the velocity of travel includes the step of varying said velocity such that a production rate of fiber tuft removal by said detaching device remains constant within a pass.

8. A method as defined in claim 1, wherein said detaching device comprises a rotating detaching roll; further wherein said step of varying the speed of travel comprises the step of simultaneously reducing the speed of travel of the bale opener and the rpm of said detaching roll.

9. A method as defined in claim 1, wherein said detaching device comprises a rotating detaching roll; further wherein said step of varying the speed of travel comprises the step of simultaneously increasing the speed of travel of the bale opener and the rpm of said detaching roll.

10. A method as defined in claim 1, further comprising the step of rotating the detaching device about a horizontal axis oriented perpendicularly to a direction of said back-and-forth travel for setting said detaching device at a desired angle to said direction.

11. A bale opener for detaching fiber tufts from a top surface of serially-arranged fiber bales, comprising (a) a tower;

(b) a first motor means for propelling the tower back-and-forth in a horizontal path of travel along the fiber bale series;

(c) a detaching device mounted on the tower and projecting laterally therefrom; said detaching device supporting a detaching element for penetrating into the top surface of the bale series for removing fiber tufts therefrom in passes over the fiber bale series during travel of the tower;

(d) second motor means for vertically displacing said detaching device relative to said tower; and (e) means for automatically varying a travelling speed of said tower during selected passes of the detaching device.

12. A bale opener as defined in claim 11, further comprising pressing rolls supported in said detaching device; said pressing rolls being positioned for engaging the top bale surface upstream and downstream of said detaching element as viewed in a direction of travel of said tower.

13. A bale opener as defined in claim 11, further comprising a third motor means for rotating said detaching element, and a control device operatively connected to said first and third motors for coordinating the travelling speed of the tower with the rotary speed of said detaching element.

14. A bale opener as defined in claim 11, further comprising means for rotatably supporting said detaching device on said tower about a horizontal axis oriented transversely to said path of travel and means for setting a desired angular position of said detaching device by rotating said detaching device about said horizontal axis.

15. A bale opener as defined in claim 14, further comprising a support for mounting said detaching device on said tower for vertical displacement of the detaching device relative to said tower; further wherein said means for rotatably supporting said detaching device includes a ring gear affixed to said detaching device.

16. A bale opener as defined in claim 15, further comprising a third motor means for driving said ring gear; said third motor means being mounted on said support.

17. A bale opener as defined in claim 15, further comprising a suction duct disposed within said detaching device and said tower for guiding away fiber tufts from said detaching device; said suction duct having a suction duct portion passing through said support; said axis forming a central longitudinal axis of said suction duct portion.

* * * * *